United States Patent [19]

Curtis et al.

[11] Patent Number: 4,699,076

[45] Date of Patent: Oct. 13, 1987

[54] SAFETY DECK SYSTEM

[76] Inventors: Richard M. Curtis, 242 Princeton Inn College; Thomas G. Kreutz, 140 Quaker Rd., both of Princeton, N.J. 08540

[21] Appl. No.: 820,836

[22] Filed: Jan. 22, 1986

Related U.S. Application Data

[63] Continuation of Ser. No. 598,429, Apr. 9, 1984, abandoned.

[51] Int. Cl.[4] ..... B63C 9/02

[52] U.S. Cl. ..... 114/347; 24/701; 24/697; 24/573; 24/669; 114/202

[58] Field of Search ..... 114/343, 202, 71, 347, 114/349, 361, 364, 203, 300, 201 R; 292/300; 24/701, 702, 666, 297, 326, 697, 625, 662, 573, 669, 676; 403/408, 11, DIG. 4

[56] References Cited

U.S. PATENT DOCUMENTS

| | | | |
|---|---|---|---|
| 1,391,393 | 10/1921 | Lecautre | 24/701 |
| 1,889,368 | 11/1932 | Messenger | 114/347 |
| 2,039,110 | 4/1936 | Patchen | 24/701 |
| 2,446,018 | 7/1948 | Miskimen | 24/701 |
| 3,037,596 | 6/1962 | Fordyce | 24/701 |
| 3,583,042 | 6/1971 | Ishizaka | 24/701 |
| 3,691,572 | 9/1972 | Yannes | 114/347 |
| 3,745,957 | 7/1973 | Henderickson | 114/202 |
| 3,988,808 | 11/1976 | Poe | 24/297 |
| 4,425,861 | 1/1984 | Raikamo | 114/202 |
| 4,515,335 | 5/1985 | De Rosett | 114/347 |

FOREIGN PATENT DOCUMENTS

| | | | |
|---|---|---|---|
| 755163 | 8/1956 | United Kingdom | 24/573 |

*Primary Examiner*—Joseph F. Peters, Jr.
*Assistant Examiner*—C. T. Bartz
*Attorney, Agent, or Firm*—Richard C. Woodbridge

[57] ABSTRACT

A kayak or similar water craft includes a releasable deck that allows the operator to easily evacuate the craft during an emergency. A plurality of large headed pins are preferably employed to attach the releasable deck plate to the upper surface of the hull of the vessel. The head of the pin is received in the large opening of a key hole which includes a slotted groove portion. When the pin is received in the groove portion the deck plate is securely fastened to the kayak. Forward pressure exerted by the operator causes the pins to slide out of the key holes, thereby releasing the deck plate from the craft. The deck plate is held in place by a holding handle or a clip and detent arrangement until it is ready for release. The purpose of the invention is to make it safer for water craft operators to safely and effectively evacuate a vessel during an emergency.

21 Claims, 13 Drawing Figures

SAFETY DECK SYSTEM

This application is a continuation, of application Ser. No. 598,249, filed Apr. 9, 1984 now abandoned.

DISCLOSURE DOCUMENT PROGRAM

This invention is described in Disclosure Document No. 123184 filed with the U.S. Patent and Trademark Office on Dec. 21, 1983.

BACKGROUND OF THE INVENTION

1. Field of the Invention

The invention relates to a releasable deck plate for use with a kayak or similar water craft to allow the operator of the craft to quickly and safely evacuate the cockpit during an emergency.

2. Description of the Prior Art

Kayaks were introduced in Europe in the late 1800's. These boats were constructed of wood and were used exclusively for flatwater paddling. In the 1920's, the kayak became a popular touring craft in Germany. These kayaks were made of rubberized canvas over a wood frame and were known as Faltboats. The boats were seaworthy and were used primarily for open water travel. Whitewater river running with these craft was limited to very easy stretches of whitewater. Faltboats were not sturdy enough to withstand impacts with river obstacles or the force of the water in difficult rapids. Also these boats were not designed to manuever quickly enough for demanding whitewater situations.

The development of fiberglass materials in the 1950's enabled the construction of lightweight and strong kayaks with rigid hulls and decks. These kayaks were able to withstand the forces in a whitewater river and whitewater kayaking began its development as a recreational sport.

With the advent of these new boats more difficult whitewater could be run resulting in the development of new techniques of paddling. In all of these techniques, the paddler must brace himself firmly within the boat in order to control the craft precisely. The paddler braces his knees against the underside of the deck; this can be accomplished effectively only in a craft with a rigid foredeck. The Eskimo roll, an essential safety manuever, allows the paddler to right the boat after it has turned over. He may then continue paddling instead of having to swin the rapid (which can be extremely hazardous). The Eskimo roll also requires that the paddler brace his knees in order to hold himself firmly in the boat to roll it.

As expertise in the sport of whitewater kayaking has grown paddlers are now running rivers which were previously considered to difficult to run. This advancement in the sport has not come without a price. As more difficult stretches of whitwater have been run and with the increase in the number of kayakers, the number of whitewater accidents and deaths has increased substantially. The most hazardous of these accidents is the paddler "entrapment" situation. In this common scenario the boat becomes pinned against some river obstacle by the force of the current also trapping the paddler within the boat. Most often the paddler is unable to escape because he cannot extract his legs from beneath the foredeck. Such entrapments have lead to numerous deaths as a result of hypothermia or drowning.

Pinning of the boat against obstacles cannot be prevented, and so it is necessary to devise some means by which the paddler can more easily remove his legs from the craft to avoid entrapment. This may be achieved through the introduction of a removable foredeck section into the kayak, which, when removed, substantially increases the size of the cockpit. In order to be truly useful to the whitewater paddler, the removable foredeck must fulfill two criteria. First, it must be rigidly attached to the rest of the boat during normal operation in order to provide structural strength to the kayak. This also allows the paddler to brace his knees for manuevering and rolling (as described above). Secondly, the removable foredeck must be manually releasable in such as way as to separate from the craft only when it has been actuated by the paddler. Such an emergency escape system has never before been utilized in kayaks.

Prior art relating to emergency egress from kayak-type craft fail to meet both of these requirements. The patent of Brock U.S. Pat. No. (1,792,140) describes a sectional foredeck which opens automatically when the boat turns upside down. The patent of Von Moltke (DM No. 536,699) describes a flexible, sealed spraydeck which rolls open automatically when the boat is turned over. The patent of Hart (DM No. 507,952) describes a flexible deck with stiffeners which can be lifted up by the paddler and which also opens automatically when the boat is turned over. The automatic aspect of theis prior art forces the paddler to exit the craft every time it is turned upside down. In addition the paddler is unable to brace his knees firmly against the underside of the foredeck in these systems because the foredeck is not firmly attached to the remainder of the boat. For these reasons such prior art is totally unsuitable for modern whitewater kayaking which requires frequent use of the Eskimo Roll and constant knee bracing.

SUMMARY OF THE INVENTION

Briefly described the invention comprises a releasable deck plate for use on a kayak or similar water craft having a substantially rigid deck. According to the preferred embodiment a removable foredeck section, the deck plate, is located directly forward of the kayak operator. The kayak operator normally sits in the cockpit with his knees directly under the releasable deck plate. The lip of the extended cockpit area includes a plurality of key hole like apertures having a large opening and a relatively narrow grooved slot body. A corresponding plurality of attachment pins are carried around the periphery of the releasable deck plate. Each of the pins includes an enlarged head and a relatively smaller shaft. Each of the key holes in the lip of the extended cockpit area is oriented so that the large opening faces towards the bow of the kayak and the narrow slot faces towards the cockpit. The deck plate is attached to the kayak by slipping the attachment pin heads into the key hole apertures and then drawing the deck plate towards the operator in such a way as to engage the shank of the attachment pins in the narrow slotted section of the key holes. The deck plate is held in place by a holding handle or a clip and detent arranged until it is ready for release. Disengagement of the releasable deck plate is achieved by removing the holding handle and pushing the deck plate forward in the direction of the bow. That action causes the attachment pins to slide out of the key holes thereby releasing the deck plate from the upper deck of the craft.

Other alternative embodiments are also described to achieve the same results. According to one embodiment a plurality of attachment pins pass through holes in the deck plate and the upper structure of the kayak. The ends of those pins are held in place by retainer clips. A cable connects the retainer clips in such a fashion that a good pull on the cable will separate the retainer clips from the attachment pins thereby releasing the deck plate from the kayak. According to yet another embodiment of the invention the deck plate is attached to the upper deck of the kayak by means of tabs which engage a plurality of catches.

These and other features of the invention will be more fully understood by reference to the following drawings and detailed description.

DETAILED DESCRIPTION OF THE PREFERRED EMBODIMENT

During the course of this description like numbers will be used to identify like elements according to the different figures which illustrate the invention 10.

Figure 1A:
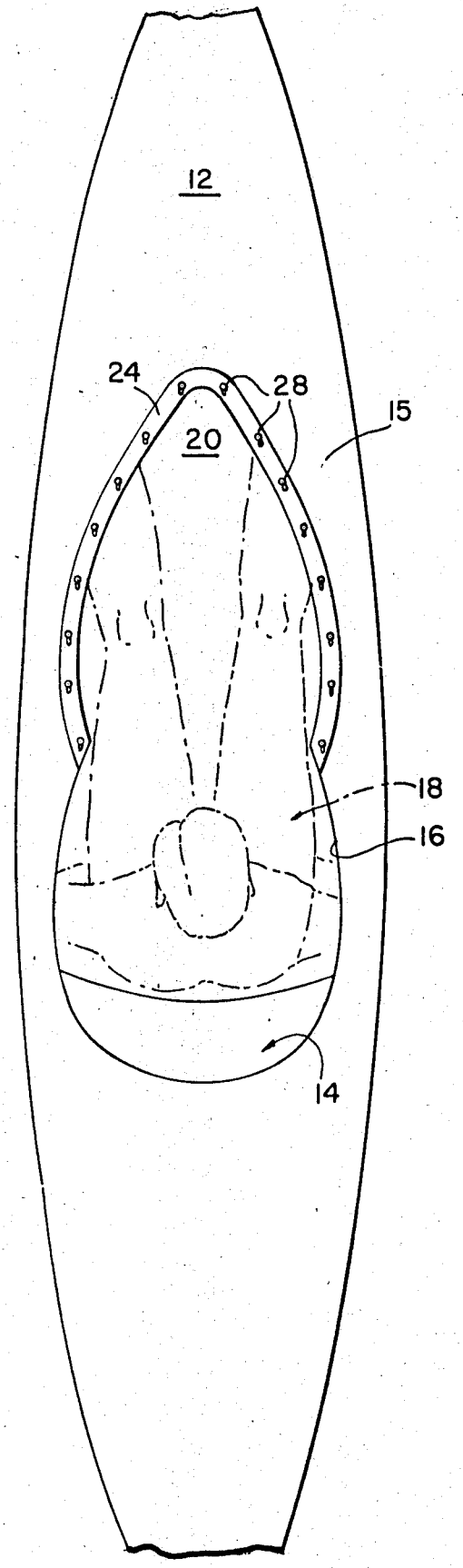
FIG. 1A is a top plan view of a decked water craft with the releasable deck plate removed showing the location of the operators knees and legs.
Figure 1B:
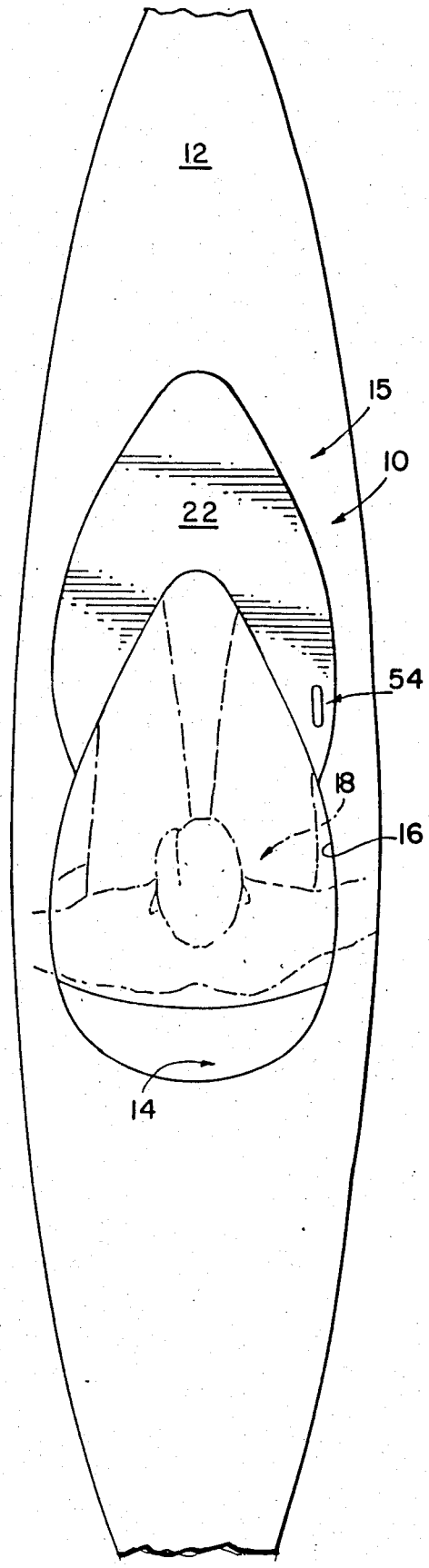
FIG. 1B is a top plan view of the preferred embodiment of the present invention showing the releasble deck plate as attached to the decked water craft.

FIG. 1A of the drawings illustrates a decked water craft 12 which includes a cockpit opening 14 surrounded by a rim 16. The operator 18 is seated inside the water craft 12 with his knees and legs extending forward beneath the upper hard surface 15 of the vessel 12. The upper torso of the operator 18 is located above and outside of the cockpit opening 14. The size of the cockpit opening 14 is increased by the inclusion of an extended cockpit opening 20 which extends forward past the knees of the operator 18. The extended cockpit opening 20 is completely covered by a removable, releasable deck plate 22 as shown in FIG. 1B. The releasable deck plate 22 in combination with the attachment and locking mechanism for connecting the releasable deck plate to lip 24 comprise the basic invention 10. The deck plate 22 covers a portion of the forward cockpit rim or lip 24. The operator 18 typically braces his knees against the underside of the deck plate 22. Along the inside edge of the extended cockpit opening 20 there is a lip 24 upon which the overlapping deck plate 22 rests. Fastening of the deck plate 22 to the hard deck 15 of the water craft 12 occurs at the juncture of the deck plate 22 and the lip 24. Many points of fastening are preferably used to attach releasable deck plate 22 to the lip 24. Structural rigidity of the water craft 12 is maintained through the multiplicity of fastening points.

Figure 2:
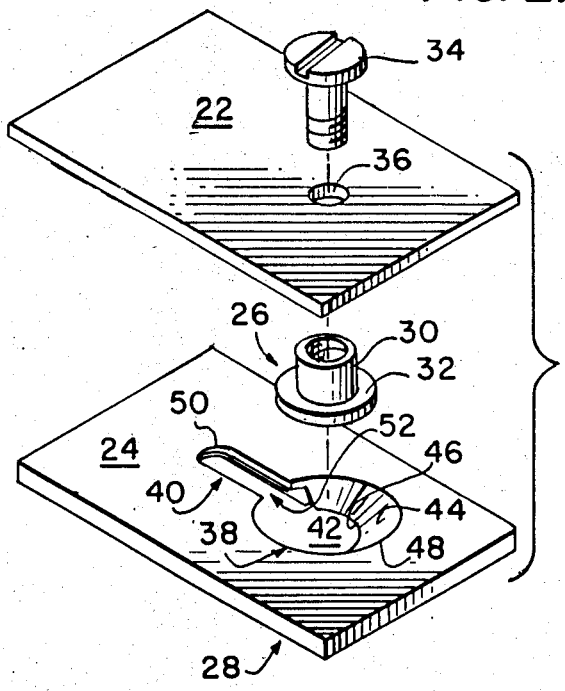
FIG. 2 is an exploded view of the preferred manner in which the attachment pins on the releasable deck plate engage with the key hole openings in the lip of the extended cockpit area.

The preferred embodiment of the fastening mechanism is illustrated in FIG. 2. A series of attachment pins 26 are mounted on the underside of releasable deck plate 22 and mate with corresponding key-holed shaped openings 28 in lip 24. When the releasable deck plate 22 is placed upon the lip 24 and pulled rearwardly, towards the cockpit opening 14, the attachment pins 26 move into the key holes 28 thereby connecting the releasable deck plate 22 to the lip 24. Conversely when the releasable deck plate 22 is pushed forward, towards the bow of the water craft 12, the attachment pins 26 are automatically released from key holes 28, thereby completely separating the releasable deck plate 22 from the water craft 12.

Each attachment pin 26 comprises a cylindrical fitting including a shaft 30 attached to a larger diameter head 32. The attachment pin 26 is mounted on the underside of the releasable deck plate 22 by, for example, a screw 34 which extends through a hole 36 in releasable deck plate 22. The overall length of the attachment pin 26 is slightly less than the thickness of the lip 24.

Figure 3:
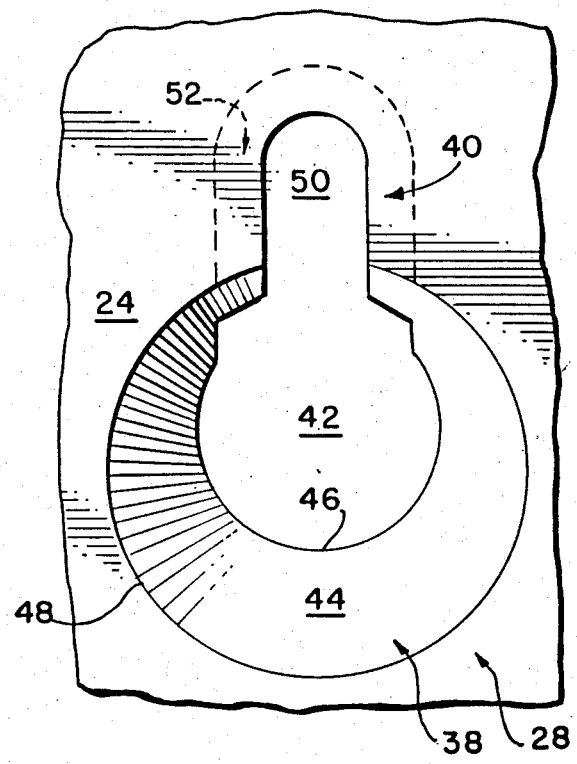
FIG. 3 is a top plan view of the key hole illustrated in FIG. 2.
Figure 4:
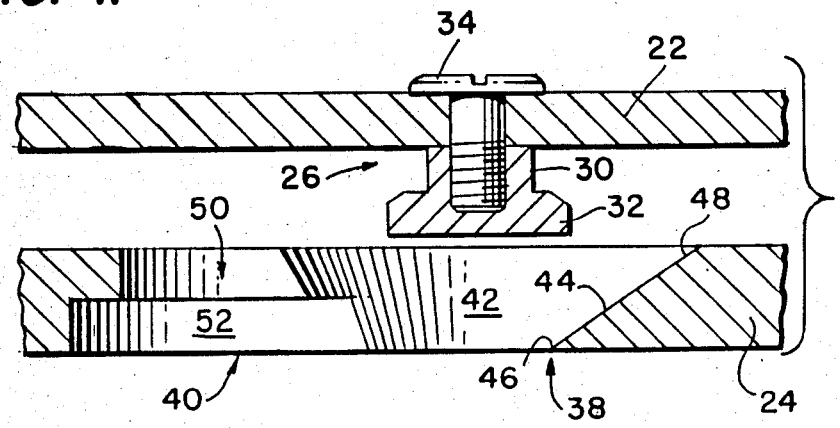
FIG. 4 is a cross-sectional cut away view of the preferred embodiment of attachment illustrating an attachment pin prior to engagement with a key hole.
Figure 5:
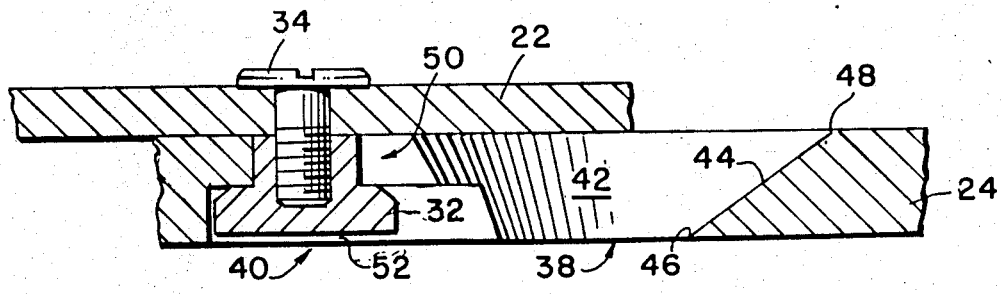
FIG. 5 is a cross-sectional cut away view of the preferred attachment means illustrating the engagement of an attachment pin in a key hole.

The key holes 28 are comprised of two sections, namely a hole section 38 and a slot section 40 as shown in FIGS. 3, 4 and 5. The hole section 38 has a hole portion 42 which extends through lip 24 and has walls 44 which flare outward from the bottom. The hole portion 42 has a lower edge 46 which is of a smaller diameter than the upper edge 48. In other words, hole 42 flares outwardly. The diameter of the lower edge 46 of hole 42 is slightly greater than the diameter of the attachment pin head 32. The slot section 40 comprises a slot portion 50 through the lip 24 and a groove 52 that lies directly beneath slot 50. The slot 50 extends rearwardly from the rear edge of hole 42 and has a width which is slightly larger than the diameter of the attachment pin shaft 30. The groove 52 has a width which is slightly larger than the attachment pin head 32. The depth of the slot 50 is slightly less than the length of the attachment pin shaft 30 and the depth of the groove 52 is slightly larger than the thickness of the attachment pin head 32. The length of the groove 52 is longer than the overlying slot 50 by at least one half of the diameter of an attachment pin head 32. The key holes 28 are preferably aligned such that the hole section 38 points towards the bow of the water craft 12 and the slot section 40 points towards the stern of the water craft 12.

Prior to attaching the releasable deck plate 22 to the water craft 12, it is first necessary to align the attachment pins 26 opposite their corresponding key holes 28. At each attachment point the flared walls 44 of the hole sections 38 help to guide the attachment pin head 32 down to the bottom of the hole 42 in front of the groove 52 as shown in FIGS. 4 and 5. Pulling the deck plate 22 sternward simultaneously pulls the attachment pin shaft 30 into the slot 50 and the attachment pin head 32 into the groove 52 beneath. Since the attachment pin head 32 has a diameter which is larger than the width of the overlying slot 50, the attachment pin 26 cannot be lifted upward. Since the width of the slot 50 is only slightly larger than the diameter of the attachment pin shaft 30, the attachment pin 26 cannot be moved in any direction except forward toward the hole section 38. Thus, when the deck plate 22 is in its attached mode, it cannot be moved with respect to the craft 12 in any direction except towards the bow for release.

Pushing the deck plate 22 forward towards the bow moves each attachment pin 26 from its respective slot 50 into the hole section 38 of the key hole 28. The flared walls 44 of the hole portion 42 direct the attachment pin head 32 up and out of the key hole 28, completely releasing the deck plate 22 from the craft 12. Since the attachment pin 26 is shorter than the thickness of the lip 24, the attachment pin head 32 cannot become caught inadvertently under any lower edge 46 of the hole section 38.

Figure 6:
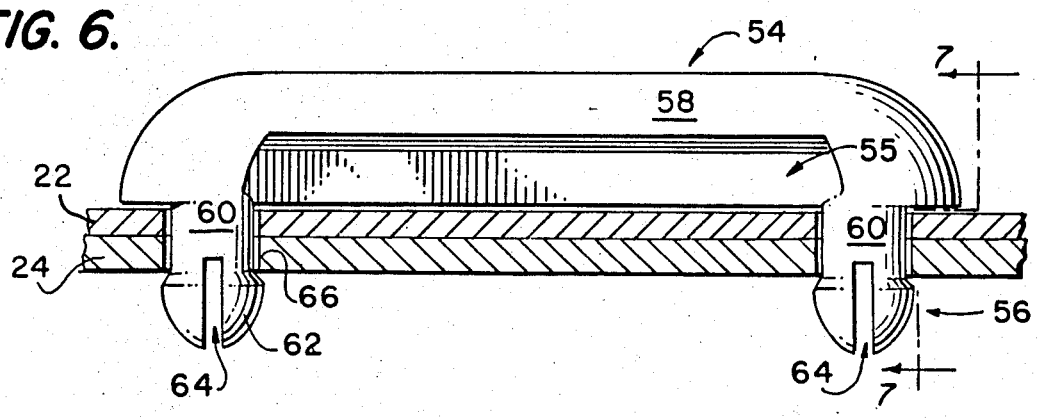
FIG. 6 is a cross-sectional elevational view of a locking handle and associated locking pins as employed to hold the deck plate in position thereby preventing accidental release of said deck plate from the water craft.
Figure 7:
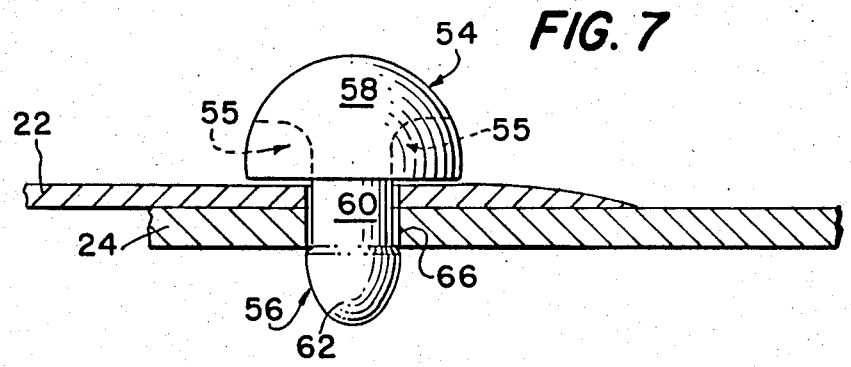
FIG. 7 is a cross-sectional elevational view of the holding, locking handle illustrated in FIG. 6 as seen along the long axis of the water craft.

When the deck plate 22 is in the attached mode, it must be constrained so that it does not accidentally release. In one embodiment the constraint or locking of the deck plate 22, is achieved by means of a locking handle 54. A pair of indented cavities 55 located on both sides of handle 54 make the handle 54 easier to grab. Locking handle 54 includes one or more locking pins 56 attached to a handle section 58 as shown in FIGS. 6 and 7. Each locking pin 56 includes a cylindrical shaft 60 and a slightly larger diameter locking pin end 62 which is located at the end of the longitudinal axis of the locking pin 56. Locking holes 66, which are of a diameter slightly larger than the locking pin shafts 60 and which have a smaller diameter than the locking pin ends 62, are included in both the releasable deck plate 22 and lip 24. Locking holes 66 become aligned when the releasable deck plate 22 is in the attached position. Locking holes 66 are located near the cockpit rim within reach of the operator 18. The releasable deck plate 22 may then be locked in this position by the insertion of the locking handle pins 56 through the locking holes 66. The locking pins 56 are made of semi-rigid material which, in combination with longitudinal pin slots 64 allow for slght compression of the locking pin ends 62 as they are inserted through the locking holes 66. When the locking pin ends 62 have passed through the locking holes 66 of both the deck plate 22 and the lip 24, they expand back to their original diameter which is larger than the diameter of the locking holes 66. The expanded locking pin ends 62 prevent the removal of the locking pins 56 from the locking holes 66 except upon the application of a sufficient, significant upward force on the locking handle 54 as might be manually exerted by the operator 18. The presence of the locking pin shafts 60 in the locking holes 66 prevents foward motion of the releasable deck plate 22 which would result in its release. In order to release the deck plate 22 the operator 18 must pull the locking handle 54 upwards and out of locking holes 66. The operator 18 may then release the releasable deck plate 22 by pushing forward on the deck plate 22 as previously described.

Figure 8A:
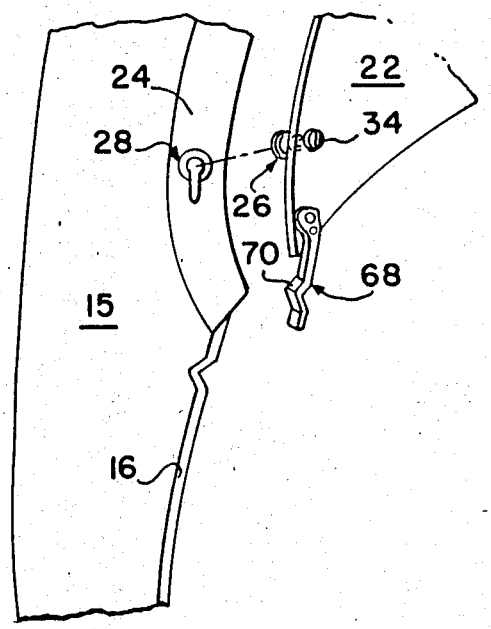
FIG. 8A is a detailed top plan view of an alternative holding means which comprises a resilient, release prevention clip located at the edge of the deck plate and the cockpit area.
Figure 8B:
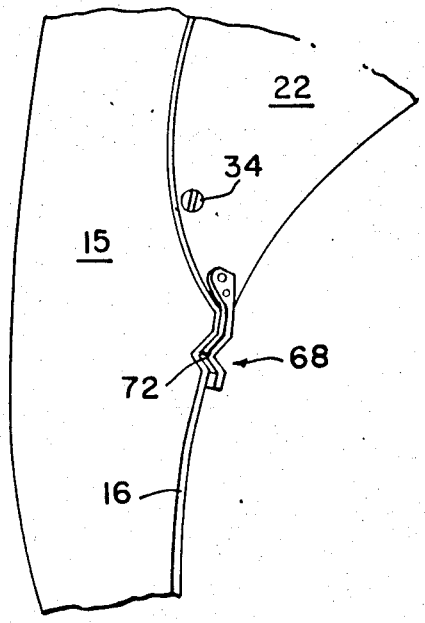
FIG. 8B is a detailed top plan view of the resilient, release prevention clip of FIG. 8A shown with the resilient clip engaged with an indent in the cockpit area.

FIGS. 8A and 8B illustrate an alternative release prevention mechanism which consists of one or more semi-rigid, resilient clips 68 attached to and protruding from an edge of the deck plate 22. The clips 68 overlap the remainder of the deck 15 of the craft 12 which is adjacent to the releasable deck plate 22 when the deck plate 22 is in the attached mode. The clip 68 is configured with a bend 70 such that when the releasable deck plate 22 is pulled into the attached mode, the bend 70 snaps firmly into a corresponding notch 72 in the edge of the cockpit rim 16. The clips 68 require a relatively high force forward to disengage the bend 70 from the notch or detent 72, thus preventing accidental release of the deck plate 22. With sufficient forward force from the operator 18, the bend 70 will disengage from the notch 72 allowing the complete release of the deck plate 22 from the craft 12.

Figure 9:
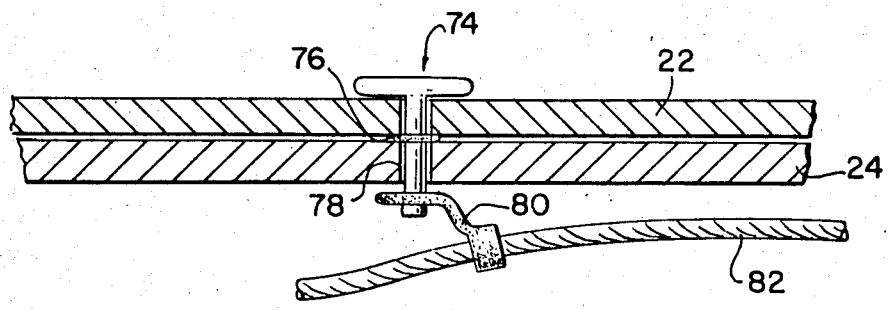
FIG. 9 is a cross-sectional view of an alternative embodiment of the invention in which the releasable deck plate is attached to the lip of the cockpit section by means of a plurality of attachment pins held in position by a plurality of retention clips all connected together on a cable.
Figure 10:
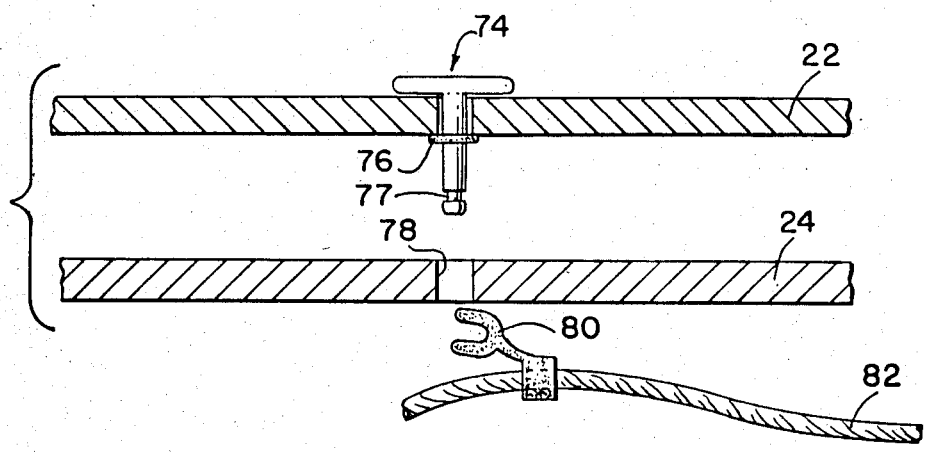
FIG. 10 is a cross-sectional view of the embodiment of FIG. 9 illustrating the manner in which the retention clips are separated from the attachment pins thereby releasing the deck plate from the water craft.

FIGS. 9 and 10 illustrate an alternative attachment-/release mechanism which includes a plurality of attachment points. At each attachment point an attachment pin 74 is mounted to and protrudes from the bottom of the releasable deck plate 22. Attachment pins 74 are held onto the deck plate 22 by means of keepers 76. The downward protruding section of the attachment pins 74 can be inserted through corresponding holes 78 in the lip 24. Attachment and locking of the releasable deck plate 22 is achieved by means of a retaining clip 80 which prevents disengagement of the attachment pin 74 from the Lip 24. Retaining clip 80 has a U-shaped section which is received on a groove 77 at the end of the shaft of each attachment pin 74. The retaining clips 80 from each attachment point are interconnected with a cable 82 that is in turn connected to a handle within reach of the operator 18. Release of the deck plate 22 is accomplished by pulling handle and cable 82 in the direction of the operator 18 thereby dis-engaging the retaining clips 80 from the attachment pins 74. The releasable deck plate 22 can then be lifted upwards and off of the craft 12.

Figure 11:
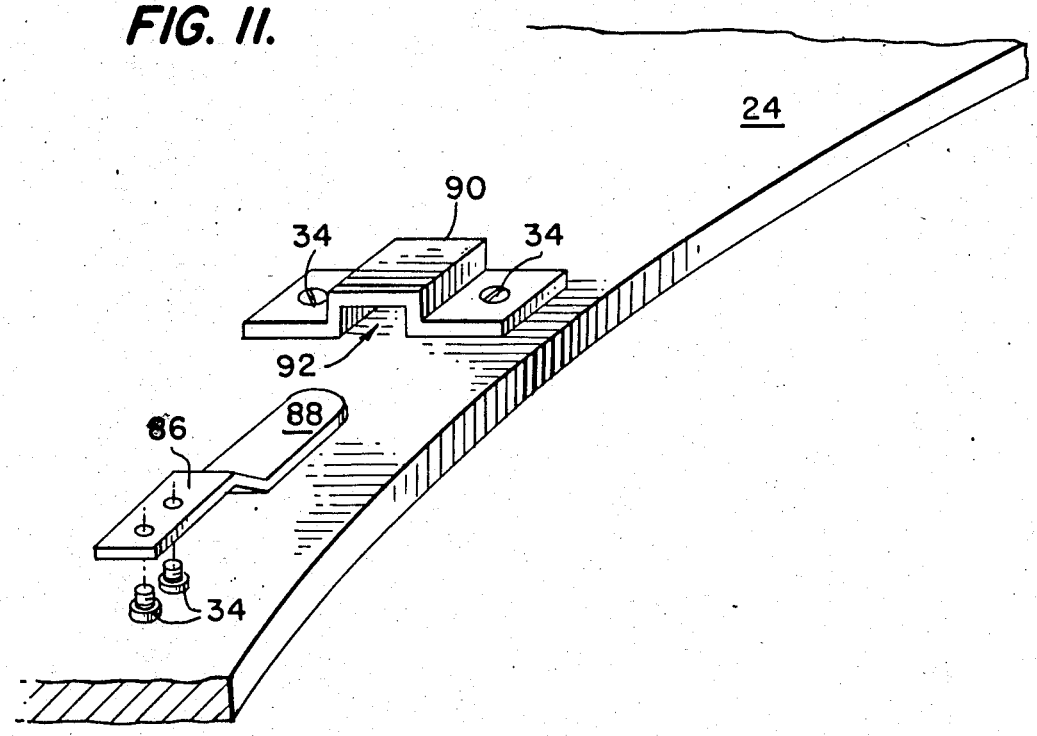
FIG. 11 illustrates an alternative embodiment of the invention in which the releasable deck plate is attached to the water craft by means of a plurality of tab and catch elements.

Another alternative embodiment of the attachemnt-/release mechanism is illustrated in FIG. 11. The alternative embodiment comprises a catch/tab combination adapted for sliding engagement and disengagement. A tab 86 is attached to the bottom of deck plate 22 by means of screws 34. Tab 86 includes a tongue 88 at the free end thereof. A catch 90 is attached by screws 34 to the top of lip 24. Catch 90 includes an aperture 92 for receiving the tab tongue 88. Deck plate 22 is attached to the water craft 12 by engaging the tab tongues 88 in the catch apertures 92 of the respective tab/catch mechanism. Release of the deck 22 is achieved by pushing forward on the deck plate 22 therby causing the tab tongues 88 to disengage from the catch apertures 92. The tab/catch mechanisms are preferably mounted so that the mechanisms disengage when the deck 22 is urged forward by the operator 18 in the direction of the bow of the water craft 12.

The invention has been described with reference to a preferred embodiment thereof. However, some other modifications are possible. First of all, while a kayak has been described as the preferred water craft 12, the invention may have applicability to other water craft having similar characteristics. Also, while the term "key hole" has been used to describe the nature of holes 28, it will be appreciated that other configurations may achieve the same result.

While the invention has been described with reference to the preferred embodiment thereof, it will be appreciated by those of ordinary skill in the art that various changes may be made to the elements and to the structure of the invention and the parts thereof without departing from the spirit and scope of the invention as a whole.

We claim:

1. A releasable deck plate apparatus for use with a watercraft having a bow, a substantially rigid upper deck and a cockpit opening in which the operator of said watercraft sits while operating said watercraft, said apparatus comprising:

a substantially rigid deck plate means for increasing the size of said cockpit opening, said deck plate means located adjacent to said cockpit opening and between said cockpit opening and the bow of said watercraft; and, slidably releasable fastener means for attaching said deck plate means to said rigid upper deck and for slidably releasing said deck plate means from said rigid upper deck, said slidably releasable fastener means including a plurality of female means for receiving male means and a plurality of male means having a narrow shank and a relatively broad head for engaging said female means and for slidably disengaging from said female means, said female means comprising a plurality of apertures having a keyhole-like cross-section and oriented in such a fashion that the wide end of said keyhole-like cross-section of said female means is directed towards the bow of said watercraft and the narrow end of said keyhole-like cross-section of said female means is directed towards the cockpit opening of said watercraft, wherein a single force applied to the edge of said deck plate means by said operator while seated within said cockpit opening in a direction substantially parallel to the plane of said deck plate means and in the direction of said bow causes said deck plate means to slidably release from said rigid upper deck and from encircling the operator thereby substantially increasing the area of said cockpit opening in order to permit the operator of said watercraft to safely exit from said watercraft in an emergency.

2. The apparatus of claim 1 further comprising:

releasable holding means for preventing said releasable fastener means for accidentally releasing said deck plate from said rigid upper deck, wherein releasing of said releasable holding means allows the operator of said watercraft to remove said deck plate by applying said force to said deck plate in a direction substantially parallel to the plane of said deck plate.

3. A releasable deck plate apparatus for use with a watercraft having a bow, a substantially rigid upper deck and a cockpit opening in which the operator of said watercraft sits while operating said watercraft, said apparatus comprising:

a substantially rigid deck plate means located adjacent to said cockpit opening and lying between said cockpit opening and the bow of said watercraft; and, slidable releasable fastener means for attaching said deck plate means to said rigid upper deck and for slidably releasing said deck plate means for said rigid upper deck, said releasable fastener means including a plurality of aperture means and a plurality of tab means having tongues slidably receivable in said aperture means, wherein a single force applied by said operator while seated within said cockpit opening to the edge of said deck plate means in a direction substantially parallel to the plane of said deck plate means and in the direction of said bow causes said tab means to slidably disengage from said aperture means thereby separating said deck plate means from said rigid upper deck and from encircling the operator and substantially increasing the area of said cockpit opening so that the operator of said watercraft may safely exit from said watercraft in an emergency.

4. The apparatus of claim 3 further comprising:

releasable holding means for preventing said releasable fastener means from accidentally releasing said deck plate from said rigid upper deck, wherein releasing of said releasable holding means allows the operator of said water craft to remove said releasable deck plate by applying said force to the edge of said deck plate and in a direction substantially parallel to the plane of said deck plate.

5. A releasable deck plate apparatus for use with a watercraft having a bow, a substantially rigid upper deck and a cockpit, said apparatus comprising:

a substantially rigid deck plate locatable forward of said cockpit in the direction of the bow of said watercraft;

releasable fastener means for attaching said deck plate to said rigid upper deck and for slidably releasing said deck plate from said rigid upper deck; and, releasable holding means for preventing said releasable fastener means from accidentally releasing said deck plate from said rigid upper deck, said releasable holding menas including resilient clip means attached adjacent to the interface of the edge of said deck plate and said cockpit for preventing accidental release of said deck plate, said resilient clip means including a resilient clip attached to said deck plate and carrying a male protrusion means thereon and a female indentation means in the side of said cockpit for engagement with said male protrusion means, wherein application of a force by the operator in a direction substantially parallel to the plane of said rigid deck plate causes said releasable fastener means to disengage and said rigid deck plate to slidably release form said rigid upper deck.

6. A releasable deck plate apparatus for use with a watercraft having a bow, a substantially rigid upper deck and a cockpit opening in which the operator of said watercraft sits while operating said watercraft, said apparatus comprising:

a substantially rigid deck plate locatable forward of said cockpit opening in the direction of the bow of said watercraft;

releasable fastener means for attaching said deck plate to said rigid upper deck and for slidably releasing said deck plate from said rigid upper deck; and, releasable holding means for preventing said releasable fastener means from accidentally releasing said deck plate from said rigid upper deck, said releasable holding means including a handle, expandable pin means attached to said handle, and aperture means in said deck plate and said rigid upper deck of siad watercraft for receiving said pin means, wherein the releasing of said releasable holding means allows the operator of said watercraft while sitting in said cockpit opening to remove said releasable deck plate by selectively applying a single force in a direction substantially parallel to the plane of said rigid deck plate to cause said rigid deck plate to slidably release from said rigid deck and from encircling the operator thereby creating a substantially larger cockpit opening to permit the operator of said watercraft to escape from said watercraft in an emergency.

7. A releasable deck plate apparatus for use with a watercraft having a bow, a substantially rigid upper deck and a cockpit opening in which the operator of said watercraft sits while operating said watercraft, said apparatus comprising:

a substantially rigid deck plate means located adjacent to said cockpit opening and between said cockpit opening and the bow of said watercraft;

slidably releasable fastener means for attaching said deck plate means to said rigid upper deck and for slidably releasing said deck plate means from said rigid upper deck; and, releasable holding means for preventing said slidably releasable fastener means from accidentally releasing said deck plate means from said rigid upper deck, wherein the releasing of said releasable holding means permits the operator of said watercraft while sitting in said cockpit opening to remove said deck plate means and from encircling the operator by selectively applying a single force to said deck plate means in a direction substantially parallel to the plane of said deck plate means and in the direction of said bow thereby substantially increasing the area of said cockpit opening to permit said operator to safely exit from said watercraft in an emergency.

8. The apparatus of claim 7 wherein said releasable holding means comprises:

resilient clip means attached adjacent to the interface of the edge of said deck plate means and said cockpit opening for preventing accidental release of said deck plate means.

9. The apparatus of claim 7 wherein said releasable holding means comprises:

a handle;

expandable pin means attached to said handle; and, aperture means in said deck plate means and said rigid upper deck of said watercraft for receiving said pin means.

10. A releasable deck plate apparatus for use with a watercraft having a bow, a substantially rigid upper deck and a cockpit opening in which the operator of said watercraft sits while operating said watercraft, said apparatus comprising:

a substantially rigid deck plate locatable forward of said cockpit opening in the direction of the bow of said watercraft;

releasable fastener means for attaching said deck plate to said rigid upper deck and for slidably releasing said deck plate from said rigid upper deck; and, releasable holding means for preventing said releasable fastener means from accidentally releasing said deck plate from said rigid upper deck, said releasable holding means including resilient clip means attached adjacent to the interface of the edge of said deck plate and said cockpit opening for preventing accidental release of said deck plate, wherein application of a single force by said operator while sitting in said cockpit opening in a direction substantially parallel to the plane of said rigid deck plate causes said releasable fastener means to disengage and said rigid deck plate to slidably release from said rigid upper deck and from encircling the operator thereby creating a substantially larger cockpit opening to permit said operator of said watercraft to escape from aid watercraft in an emergency.

11. A releasable deck plate apparatus for use with a watercraft having a bow, a substantially rigid deck and a cockpit opening in which the operator of said watercraft sits while operating said watercraft, said apparatus comprising:

a substantially rigid deck plate means located adjacent to said cockpit opening and between said cockpit opening and the bow of said watercraft;

slidably releasable fastener means for attaching said deck plate means to said rigid upper deck and for slidably releasing said deck plate means from said rigid upper deck; and, releasable holding means for preventing said slidably releasable fastener means from accidentally releasing said deck plate means from said rigid upper deck, said releasable holding means comprising a resilient clip means attached adjacent to the interface of the edge of said deck plate means and said cockpit opening for preventing accidental release of said deck plate means, said resilient clip means including a resilient clip attached to said deck plate and carrying a male protrusion means thereon and a female indentation means in the side of said cockpit opening for engagement with said male protrusion, wherein the releasing of said releasable holding means permits the operator of said watercraft while sitting in said cockpit opening to remove said deck plate means by selectively applying a force to said deck plate means in a direction substantially parallel to the plane of said deck plate means and in the direction of said bow thereby substantially increasing the area of said cockpit opening to permit said operator to safely exit from said watercraft.

12. A releasable deck plate apparatus for use with a watercraft having a bow, an upper deck and a cockpit opening in which the operator of said watercraft sits while operating said watercraft, said apparatus comprising:

a deck plate located adjacent to said cockpit opening and lying between said cockpit opening and said bow of said watercraft; and, slidably releasable fastener means for attaching said deck plate to said upper deck and for slidably releasing said deck plate from said upper deck, wherein the application of a single force applied by said operator while seated in said cockpit opening to said deck plate in a direction substantially parallel to the plane of said deck plate causes said deck plate to slidably release from said upper deck and from encircling the operator thereby creating a substantially larger cockpit opening to permit said operator of said watercraft to escape from said watercraft.

13. A releasable deck plate apparatus for use with a watercraft having a bow, a substantially rigid upper deck and a cockpit opening in which the operator of said watercraft sits while operating said watercraft, said apparatus comprising:

a substantially rigid deck plate located adjacent to said cockpit opening and lying between said cockpit opening and said bow of said watercraft; and, slidably releasable fastener means for attaching said deck plate to said rigid upper deck and for slidably releasing said deck plate from said rigid upper deck, wherein the application of a single force selectively applied by said operator while seated within said cockpit opening to said rigid deck plate in a direction substantially parallel to the plane of said rigid deck plate and in the direction of said bow causes said rigid deck plate to slidably release from said rigid upper deck and from encircling the operator thereby creating a substantially larger cockpit opening to permit the operator of said watercraft to escape from said watercraft in an emergency.

14. The apparatus of claim 13 wherein said releasable fastener means comprises:

female means for receiving a male means; and, male mens having a relatively narrow shank and a broad head for engaging said female means and for slidably disengaging from said female means.

15. The apparatus of claim 13 wherein said watercraft comprises a kayak.

16. The apparatus of claim 13 wherein said fastener means comprises:

an aperture means having a aperture therein; and, a tab means having a tongue receivably in said aperture in said aperture means, wherein said tongue of said tab means selectively engages and disengages the aperture in said aperture means.

17. The apparatus of claim 13 further comprising:

releasable holding means for preventing said releasable fastener means from accidentally releasing said deck plate from said rigid upper deck, wherein the releasing of said releasable holding means allows the operator of the watercraft to remove said releasable deck plate by applying said force substantially parallel to the plane of said substantially rigid deck plate.

18. the apparatus of claim 17 wherein said releasable holding means comprises:

resilient clip means attached adjacent to the interface of the edge of said deck plate and said cockpit for preventing accidental release of said deck plate.

19. The apparatus of claim 14 wherein said male means is carried by said deck plate and said female means is carried by said rigid upper deck.

20. The apparatus of claim 19 wherein said male means comprises a plurality of male fastener means and said female means comprises a plurality of female means.

21. The apparatus of claim 20 wherein said female means comprises a plurality of apertures having a keyhole-like cross section and oriented in such a fashion that the wide end of the keyhole-like cross section of said female means is directed towards the bow of said watercraft and the narrow end of said keyhole-like cross section of said female means is directed towards the cockpit of said watercraft.

* * * * *